US006138595A

United States Patent [19]

Croyle et al.

[11] Patent Number: 6,138,595

[45] Date of Patent: Oct. 31, 2000

[54] METHOD FOR CONSTRUCTING GARMENTS TO ALLEVIATE PREMATURE WEAR AROUND GARMENT POCKETS AND A GARMENT PRODUCED THEREBY

[75] Inventors: Gene F. Croyle; William Allen McLean, Jr., both of Plano, Tex.

[73] Assignee: Levi Strauss & Co., Del.

[21] Appl. No.: 09/335,208

[22] Filed: Jun. 17, 1999

[51] Int. Cl.[7] ..... A41D 27/20

[52] U.S. Cl. ..... 112/475.06; 112/475.09; 2/247

[58] Field of Search ..... 112/475.09, 475.08, 112/470.07, 470.16, 475.06, 141, 147; 2/243.1, 247, 248

[56] References Cited

U.S. PATENT DOCUMENTS 2,718,640 9/1955 Suckle ..... 2/243.1
4,022,139 5/1977 Carson ..... 112/475.09 X
4,357,197 11/1982 Wilson ..... 2/247 X
5,611,468 3/1997 Schulze et al. ..... 112/470.07 X

*Primary Examiner*—Peter Nerbun
*Attorney, Agent, or Firm*—Medlen & Carroll, LLP

[57] ABSTRACT

A garment, and a method of constructing garments, is disclosed which substantially alleviates or eliminates sources of abrasion which hitherto caused holes in the garment substrate adjacent to pockets. The method includes one or more steps of reducing the number of fabric plies in the upper corner of pockets to increase flexibility and eliminate point abrasion, increasing the distance between the peripheral stitching line and the peripheral edge of the pocket to increase the flexibility of the peripheral edge of the pocket and eliminate line abrasion, decreasing the stitch density in bar tacks whereby the stitch hole made by each stitch in a bar tack is distinct and separate from the stitch holes made by other stitches in the bar tack, and eliminating over edge stitches which tie the pocket to the garment substrate.

23 Claims, 7 Drawing Sheets

METHOD FOR CONSTRUCTING GARMENTS TO ALLEVIATE PREMATURE WEAR AROUND GARMENT POCKETS AND A GARMENT PRODUCED THEREBY

FIELD OF THE INVENTION

The present invention relates generally to cloth fabric. More specifically, the present invention relates to methods for constructing cloth garments.

BACKGROUND OF THE INVENTION

The garment industry is a slave to fashion. Consumers want, and get, the "look" which is in fashion at any particular time. Over the last ten years or more, finishing has been viewed as the way to achieve at least some garment characteristics which are desired by the consumer. Frequently, these characteristics relate to the appearance, washability or softness of the garment. Thus, chemical and mechanical agents have been used to change the appearance and feel of, for example, denim fabric to make the resulting product more desirable by the consumer.

Once such finishing techniques were widely adopted, manufacturers began to notice problems, particularly with chemically finished garments, of premature wear of garment fabrics. This seemed to occur predominantly in the area around pockets, and was often characterized by holes forming in the substrate fabric around or near the upper corners of the rear pockets on trousers such as jeans.

This problem escalated in 1994, with a very large number of returns for 1995–1997. In 1998, for example, almost half of consumer returns sent to Levi Strauss & Co. consumer affairs department were for holes around the corners of the back pockets of jeans. Other manufacturers seem to be having similar problems. Since there appears to be about a two year period from the date of manufacture to the date of return, this is a significant problem which will extend into the future for a period of several years.

This problem was initially attributed to the use of chemical agents, such as cellulase enzymes, which are difficult to control and which can significantly degrade substrate fabrics if not properly neutralized after use. However, the hole problem has more recently been observed in "hard jeans" returned to the manufacturer as a result of consumer complaints. Since "hard jeans" are garments which have not been subjected to chemical or mechanical finishing, it is clear that this problem is not one that cannot be solved alone by changing enzymes or by closer adherence to good neutralization practices during finishing.

Accordingly, the need exists for a method for producing garments to substantially alleviate the premature wear occurring around the pockets of garments.

SUMMARY OF THE INVENTION

The present invention discloses a method for producing garments which alleviates premature wear resulting from point abrasion which occur in the substrate fabric around pockets having an open upper edge, an upper corner at each end of the upper edge, and a peripheral edge defining the shape of the pocket and sewn to a garment substrate, in which a pocket workpiece is cut to include a top edge including a first end and a second end, a peripheral workpiece edge beginning at a first point and ending at a second point, the peripheral workpiece edge defining the shape of a pocket, a first miter connecting said first end and said first point, a second miter connecting said second end and said second point, folding the pocket workpiece to form an upper pocket edge, a first upper corner, a second upper corner, and a peripheral pocket edge, whereby said first and second upper corner do not extend substantially below an axis connecting said first point and said second point, and, stitching the pocket workpiece to the garment substrate along a peripheral stitching line.

The method can also eliminate problems with holes in the substrate fabric resulting from line abrasion by spacing the peripheral stitching line a sufficient distance from the peripheral pocket edge so that the peripheral edge will remain substantially flexible after sewing.

The method can further eliminate problems with holes caused by excessive stitch density in the bar tack by reducing the stitch density so that each stitch in the bar tack creates a distinct stitch hole which does not overlap or coincide with any other stitch hole made by any other stitch in said bar tack.

Finally, where finishing chemicals are used, the present method prefers the use of pH neutral enzymes, and most preferably enzymes that attack the dye without substantially affecting the tensile strength of the fabric.

The present invention also discloses and claims a garment including a garment substrate, a pocket stitched to the garment substrate having an open upper edge, a first upper corner on one end of said upper edge, a second upper corner on an opposite end of said upper edge, and a peripheral pocket edge which defines the shape of the pocket, the pocket formed from a pocket workpiece having a top edge including a first end and a second end, a peripheral workpiece edge beginning at a first point and ending at a second point, the first and second points spaced away from the top edge, a first miter connecting the first end and the first point, a second miter connecting the second end and the second point, the first upper corner and the second upper corner being located at or above an axis passing between the first point and the second point, and the pocket stitched to the garment substrate along a peripheral stitching line spaced from the peripheral pocket edge a sufficient distance so that the peripheral pocket edge will remain substantially flexible after it is sewn to the garment substrate. The garment may also include a reduced stitch density bar tack at each end of the top edge of the pocket. The stitch density should be sufficiently low so that each stitch in the bar tack creates a distinct stitch hole which does not coincide with any other stitch hole made by any other stitch in said bar tack.

Other features and advantages of the invention will become apparent from the following detailed description, taken in conjunction with the accompany drawings, which illustrate, by way of example, the principles of the invention.

DETAILED DESCRIPTION OF THE INVENTION

To understand the causes and solutions for this problem, we refer to FIG. 1 which illustrates a conventional method for creating a pocket to be sewn to a garment.

Figure 1A:
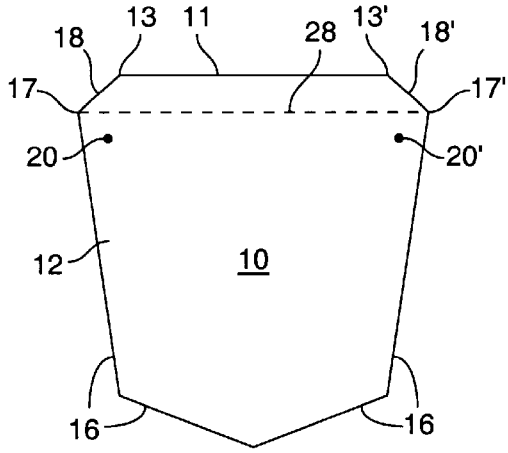
FIG. 1A (PRIOR ART)
FIGS. 1A–1H illustrates the steps of a prior art method for creating a pocket from a pocket workpiece.

As shown in FIG. 1A, the process begins with a pocket workpiece 10, having the same general shape as the finished pocket. Pocket workpiece is cut to provide a generally raw upper edge 11. The upper edge 11 extends from first end 13 to second end 13'. A typically raw workpiece peripheral edge 16 extends from a first point 17 to a second point 17' and defines the general shape of the pocket. The first point 17 and second point 17' are spaced away from upper edge 11. A small first miter 18 extends between first point 17 and first end 13, and a small second miter 18' extends between second point 17' and second end 13'. The upper corners of the pocket 20, 20' are conventionally located below an axis which intersects first point 17 and second point 17'. For purposes of this illustration, to show how the pocket is folded for attachment to the garment, the pocket workpiece 10 is shown with its inside surface 12 facing the reader.

Figure 1B:
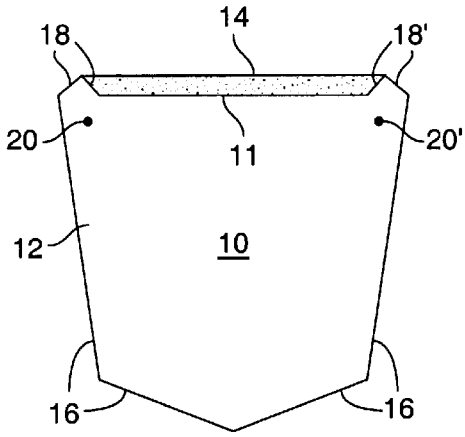
FIG. 1B (PRIOR ART)
Figure 1C:
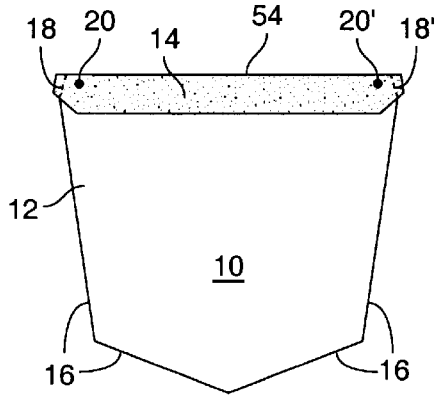
FIG. 1C (PRIOR ART)

As shown in FIG. 1B and 1C a hemmed top pocket edge 54 is created by folding the raw top edge down once, followed by folding again to encase the raw top edge 11 inside the top pocket edge 54. This typically locates three plies of fabric at the location of the top corners 20, 20', as shown in FIG. 1C.

Figure 1D:
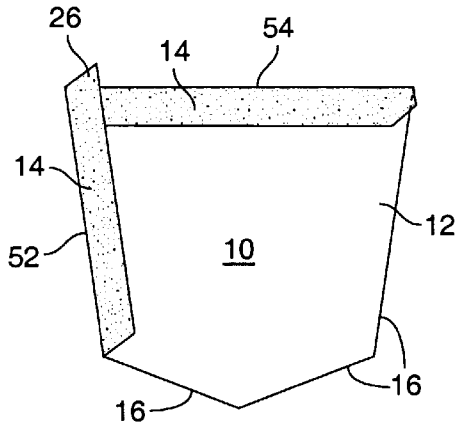
FIG. 1D (PRIOR ART)
Figure 1E:
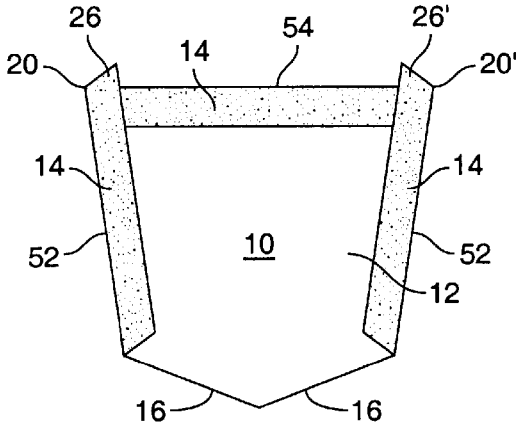
FIG. 1E (PRIOR ART)
Figure 3:
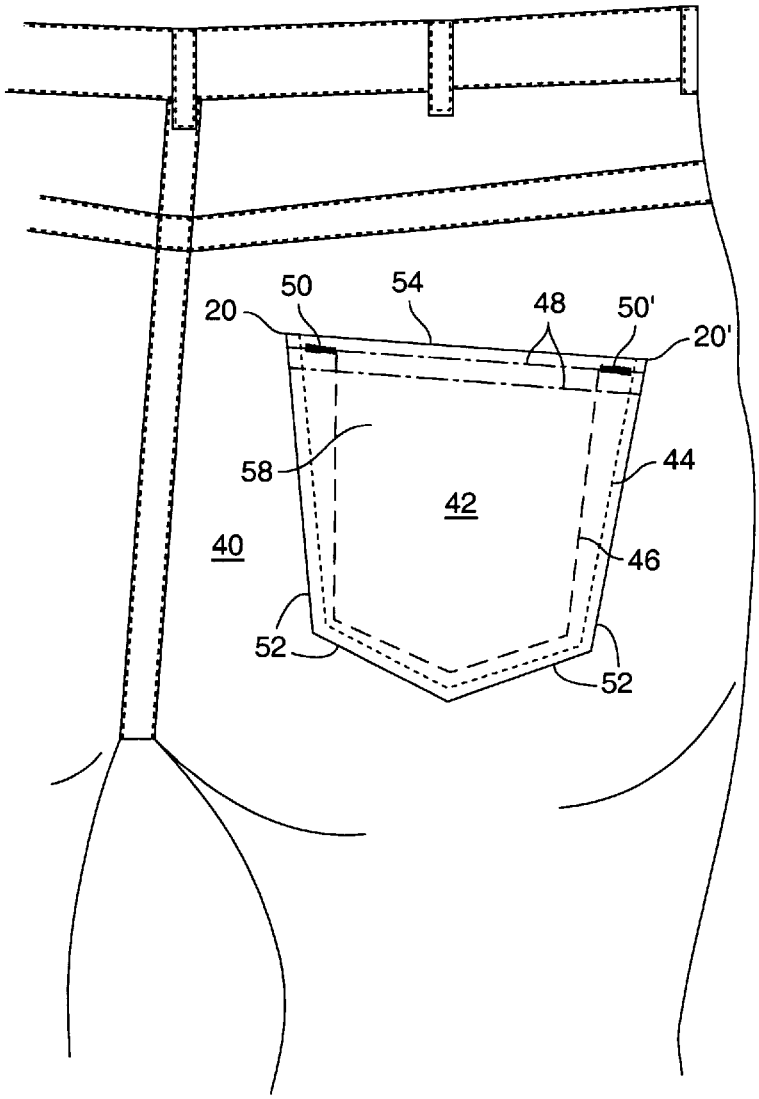
FIG. 3 illustrates a pocket of the present invention stitches to a garment substrate.

As shown in FIGS. 1D and 1E, the side edges of the pocket workpiece are then folded in against the inside surface 12 of the pocket workpiece to produce the peripheral (side) edges of the pocket 42 (as shown in FIG. 3) 52 and two upstanding flaps 26, 26' caused by the angled shape of the pocket. Folding the sides adds another two plies of fabric to the upper corners 20, 20'.

Figure 1F:
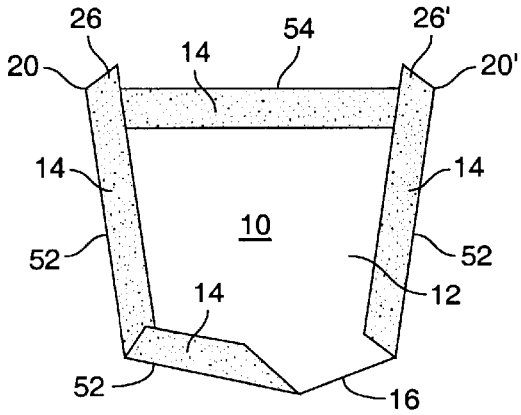
FIG. 1F (PRIOR ART)
Figure 1G:
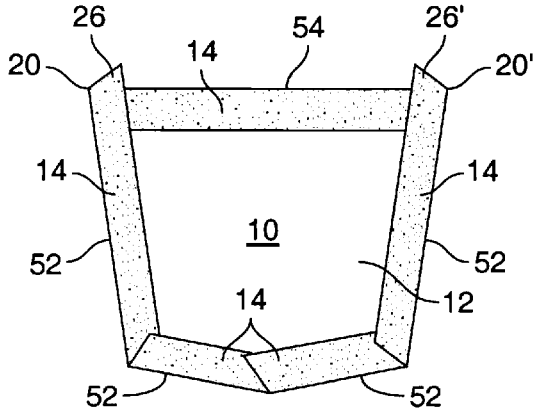
FIG. 1G (PRIOR ART)

As shown in FIGS. 1F and 1G, the bottom edges of the pocket and folded against the inside surface 12 of the pocket workpiece to complete the formation of the peripheral pocket edge 52. This step adds nothing to the upper corners 20, 20'.

Figure 1H:
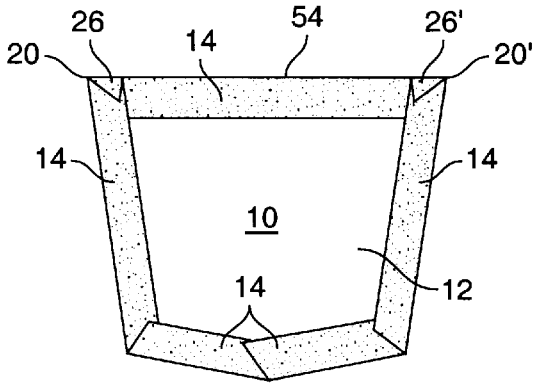
FIG. 1H (PRIOR ART)

As shown in FIGS. 1H and 3, the upstanding flaps 26, 26' are typically folded down, and the hem along the upper edge 52 is stitched down along lines 48, adding at least another 2 plies of fabric to the upper corners 20, 20' for a total of at least 7 plies of fabric.

As shown in FIG. 3, such a pocket can be secured to a garment substrate 40 by placing the inside surface 12 of the pocket 42 against the outside surface of the garment substrate 40, exposing the outside surface 56 of the pocket 42, and stitching along a peripheral stitching line 44. Peripheral stitching line 44 may, but need not, be substantially parallel with the peripheral edge 52 of the pocket. A reinforcing stitching line 46 may also be provided which defines the shape and size of the interior of the pocket 42 . A bar tack 50, 50' can be added at each end of the upper edge 54 of the pocket, if desired.

After analyzing this method of construction, we have discovered four significant mechanical causes which contribute to premature holes or wear around the pockets of garments.

Point Abrasion

This is characterized by a hole which begins in the substrate fabric at the upper corner of the pocket and radiates outward from the pocket. We believe this problem is caused by upper corners which are rigidified by excessive plies of fabric being folded into the corner to form the pocket. As a result, the upper pocket corners lose flexibility and become a rigid, abrasive point which relatively quickly abrades the substrate fabric during wear and washing, eventually wearing a hole in the substrate fabric. Most of the holes (approximately 52%) appear to be caused by point abrasion. Our approach to solving this problem is to reduce the number of fabric plies which end up in the upper corners of the pockets. The fewer the plies, the more flexible the corner will be.

Figure 2A:
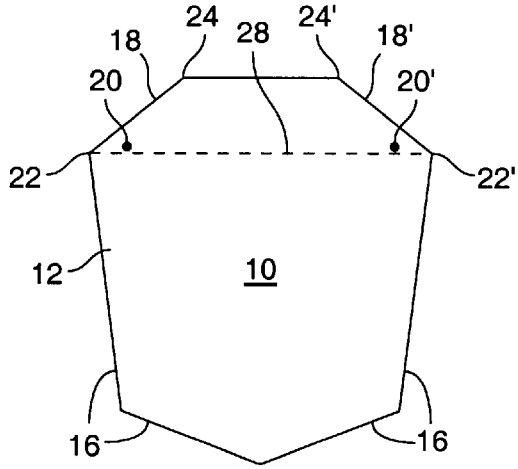
FIGS. 2A–2H illustrates a method of the present invention for creating a pocket from a pocket workpiece.
Figure 2B:
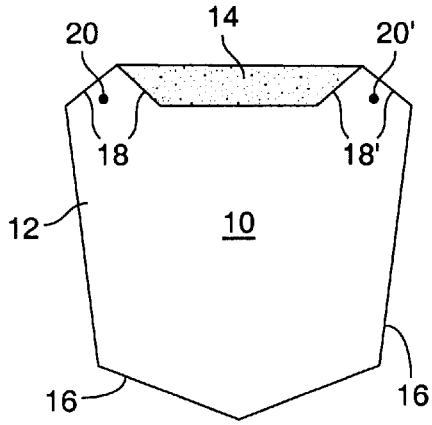
Figure 2C:
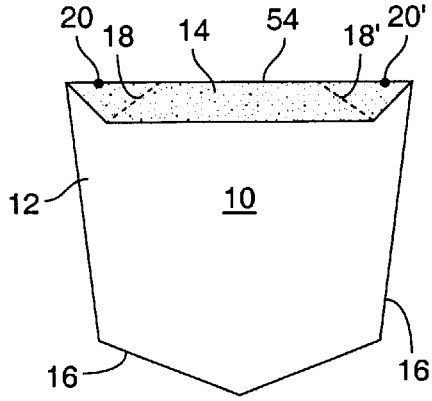
Figure 2D:
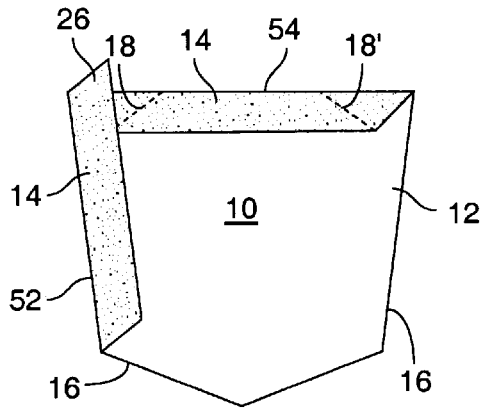
Figure 2E:
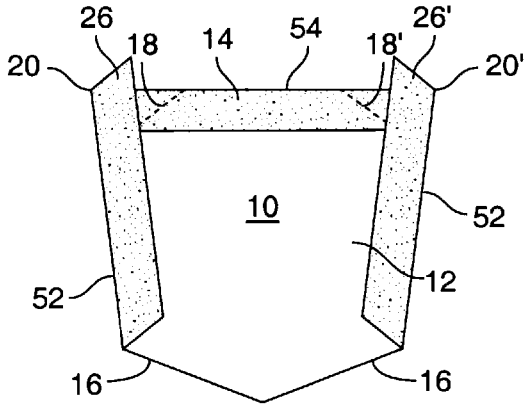
Figure 2F:
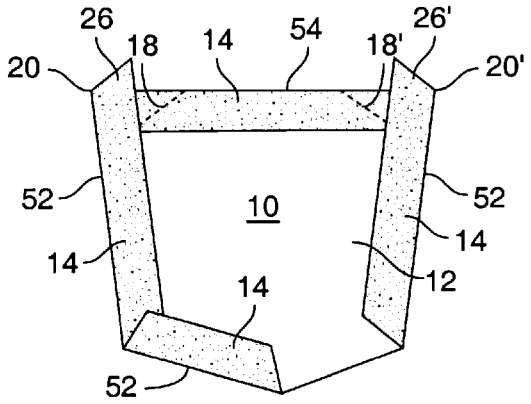
Figure 2G:
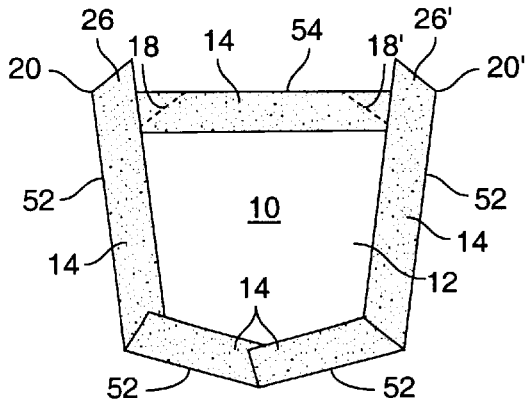
Figure 2H:
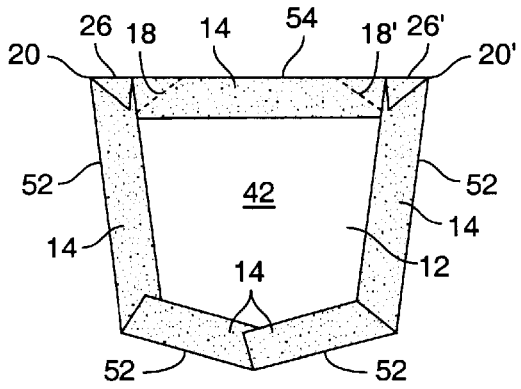

Our preferred method for correcting point abrasion is illustrated in FIGS. 2A–2H. We start out with a fabric workpiece 10 which has a smaller upper edge 11 generated by significantly increased miters 18, 18'. By moving the first and second ends 24, 24' closer together and by dropping first and second points 22, 22' down (relative to the upper edge 11), the axis connecting first and second points 22, 22' is positioned over or dropped below the ultimate location of upper corners 20, 20'. As shown in FIG. 2C, this reduces the number of plies in each upper corner caused by the hemming of the upper edge from three to two, eliminating one ply of fabric. As shown in FIGS. 2D–2F, the peripheral edges are formed (adding 2 plies of fabric to the corner) and the upstanding flaps 26, 26' and folded down (adding 1 or 2 plies of fabric to the corner). The result is a corner with 5–6 plies of fabric, rather than 7 or more plies as is found in a conventional pocket. Based upon wash tests, removal of a single ply from the corner produces increased flexibility of that corner, and eliminates or substantially reduces premature wear to the substrate fabric adjacent to the upper corners of the pockets.

Stitch Density in the Bar Tack

This is characterized by a hole which begins underneath the upper corners of the pockets at the bar tack stitch line and radiates away from the upper corners in all directions. Bar tacks are placed at each end of the upper edge 54 of a pocket to reinforce the pocket against the stress of use. Under conventional thinking, one reinforces the pocket more strongly by making a stronger bar tack. For example, the diameter of the thread in bar tacks has increased over the years in response to mechanical and chemical processing, which can wear exposed threads. However, larger thread requires the use of a larger needle. This produces an indirect increase in stitch density (since each thread is bigger, the same number of stitches must be squeezed together to get the same number of stitches per unit distance). This, in conjunction with using large needles, produces stitch holes that frequently overlap or coincide with each other. Thus, there appears to be a maximum effective stitch density related to thread size, beyond which the bar tack will produce at worst a slot in the fabric and at best a severely weakened area of the substrate fabric under the bar tack. This problem appears to produce approximately 29% of the holes experienced.

To solve this problem, we prefer to reduce the stitch density in the bar tack to a level where each stitch produces a discernable stitch hole which is distinct and separate from the stitch holes produced by the other stitches in the bar tack. For example, when using moderately heavy thread in producing jeans, our prior standards called for a pocket bar tack to have a stitch density of 40–42 stitches over approximately a ⅝ inch distance (stitch density of about 64 to 68 stitches per inch). We have substantially eliminated the hole problem caused by bar tack stitch density by reducing the density to no more than about 52 stitches per inch. We have tested stitch densities as low as about 34 stitches per inch, and found them to work well (e.g., not produce premature holes after repeated laudering). Accordingly, when bar tacks are desired, any bar tack having an appropriate stitch density and thread size (i.e., so that the stitch holes do not overlap or coincide) will add to the strength and durability of the pocket opening without substantially degrading the tensile strength of the substrate fabric, Edge Abrasion Edge abrasion is characterized by areas of significant wear or holes which appear prematurely in the substrate fabric along the peripheral edges of the pockets. We believe this problem is caused by sewing the pocket to the substrate along a peripheral stitching line which is too close to the peripheral edge of the pocket, causing the two plies of the peripheral edge to become bound together in a rigid and inflexible edge relative to the substrate fabric. The stiffness and inflexibility of the peripheral edge produces an abrasive edge which abrades the adjacent substrate material during wear and washing, causing general failure of the substrate fabric around the pockets. In addition to the damage caused by abrasion, the repeated bending and flexing of the substrate fabric around the unyielding edge may also contribute to fatigue failure of the fibers in the substrate fabric.

With reference to FIG. 3, the peripheral stitching line 44 is spaced approximately 1/16 inch from the peripheral edge 52 in a conventional pair of jeans. This, combined with operator error in sewing closer to the peripheral edge, seems to cause a rigid, inflexible, abrasive peripheral pocket edge. We have eliminated this problem by increasing the distance between the peripheral edge 52 and the peripheral stitching line 44 until the peripheral edge 52 becomes flexible and movable relative to the substrate fabric 40. In a pair of jeans, we obtained good results by increasing this distance to about 3/16 inch.

Over Edge/Deflection Stitch

Figure 5:
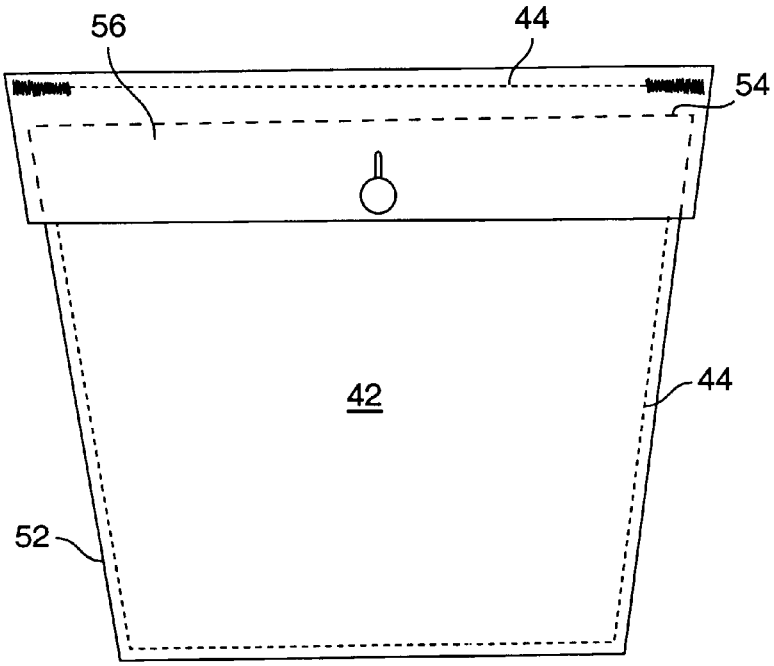
FIG. 5 illustrates an alternative pocket constructed according to the present invention, including a flap which covers the open upper edge of the pocket.

This problem is characterized by a hole pulled in the substrate fabric by one or two single stitches which cross over the peripheral edge of the pocket or the top edge of the pocket and into the substrate fabric, forming a physical tie point. When a piece of paper is tacked to the wall, all the stress on the paper is concentrated on the tack point. When the paper is pulled, the paper tears at the tack point. The same is true of garments. Such an over edge stitch concentrates the stress imparted to the pocket during use or washing to the tie point on the substrate, and will in almost every case pull a hole at that point. This problem typically occurs when stitching too close to the edge of the pocket, or by bar tacking over the edge of the pocket. This problem is also frequently seen in cargo type pockets, such as that shown in FIG. 5, which include a flap 56 covering the open upper edge 54 of the pocket 42, which may be basted in position using over edge stitches, before stitching along the peripheral stitching line 44. Such stitches, if left in place, will pull a hole in the substrate fabric as the flap is repeatedly opened to gain access to the pocket 42.

The only way to avoid premature hole problems caused by stitching over the pocket edge is to treat this as a defect, and make it subject to inspection and correction when it occurs. Correction can easily be made by simply cutting the offending stitch so that it no longer ties the pocket to the garment substrate.

Other Causes/Factors

Figure 4:
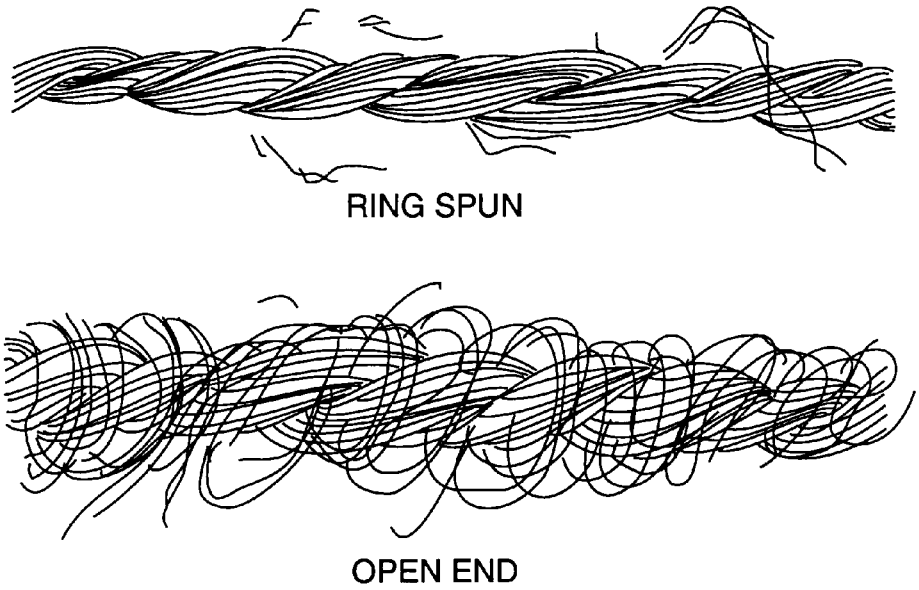
FIG. 4 illustrates the difference in surface characteristics between ring spun fabrics and open end fabrics.

The kind of fabric used to produce the garment can contribute to premature wear. Although such wear is not limited to holes around pockets, the kind of fabric used can, when exposed to the factors discussed above, affect the speed with which defects are experienced. Substandard fabrics that do not meet tear and tensile specifications are partly to blame For example, the poor cotton crop of three years ago may have contributed to the problem of holes around pockets. However, the type of fabric used for the substrate is also important. For example, far fewer customer returns were experienced for garments produced from ring spun fabrics than those produced from open end fabrics. See, e.g., FIG. 4 for an illustration of the differences in surface characteristics of ring spun and open end fabrics.

In addition, exzymes and chemical finishing agents, while not specifically attacking the substrate fabric around pockets, can weaken the substrate fabric overall and make it more susceptible to abrasion from the factors discussed above. In finishing, therefore, we prefer to use enzymes which have a pH of about 7 (i.e., neutral enzymes), and most preferably enzymes which attack the dye wihout substantially attacking the fibers or substantially degrading the tensile strength of the fabric. While less desirable, acidic enzymes can be used, but these require strict adherence to proper procedures to insure complete neutralization before fabric integrity is compromised.

The invention has been described in terms of the preferred embodiment. One skilled in the art will recognize that it is possible to construct the present invention from a variety of materials and to modify the placement of the components in a variety of ways. While the preferred embodiments have been described in detail and shown in the accompanying drawings, it will be evident that various further modifications are possible without departing from the scope of the invention as set forth in the following claims.

We claim:

1. A method for constructing garments to reduce premature wear of garment substrate fabric around pockets, each pocket having an open upper edge, an upper corner at each end of the upper edge, and a peripheral edge defining the shape of the pocket and sewn to a garment substrate, the method comprising the steps of:

cutting a pocket workpiece to form a raw upper edge including a first raw end and a second raw end, a peripheral workpiece raw edge beginning at a first point and ending at a second point, said peripheral workpiece raw edge defining the shape of a pocket, a first miter connecting said first end and said first point, a second miter connecting said second end and said second point, an inner surface and an outer surface;

folding said top raw edge against said inner surface twice along a first folding axis and a second folding axis, said first folding axis located between said top raw edge and an axis extending from said first point to said second point, and said second folding axis located between said first folding axis and said axis extending from said first point to said second point, to encase said top raw edge and form a finished upper pocket edge;

folding said peripheral workpiece raw edge once against said inner surface to form a finished peripheral edge and an upstanding flap at each tipper corner extending beyond said finished upper edge;

folding said upstanding flap at each comer down behind said finished upper pocket edge along said axis connecting said first point and said second point to form a finished upper corner at each end of said finished upper pocket edge, each said upper corner having no more than six plies of fabric;

stitching along a stitching line adjacent to the finished upper pocket edge to hold the folded upstanding flaps in position behind and below said finished upper edge;

positioning said pocket workpiece on said garment substrate; and, stitching said pocket workpiece to the garment substrate along a peripheral stitching line.

2. The method of claim 1 wherein said peripheral stitching line is spaced a sufficient distance from the peripheral edge so that the peripheral edge will remain substantially flexible after sewing.

3. The method of claim 2 wherein said distance between said peripheral edge and said peripheral stitching line is about 3/16 inch.

4. The method of claim 1 additionally including the step of adding a rein forcing bar tack to each upper corner, said reinforcing bar tack having a stitch density sufficiently low so that each stitch in said bar tack creates a distinct stitch hole which does not coincide with any other stitch hole made by any other stitch in said bar tack.

5. The method of claim 4 wherein said stitch density of said bar tack does not exceed about 52 stitches per inch.

6. The method of claim 4 wherein said bar tack does not extend into the region between the peripheral edge and the peripheral stitching line.

7. The method of claim 1 wherein the pocket workpiece is stitched to the garment substrate without stitches that cross from the pocket to the garment substrate over the peripheral edge.

8. The method of claim 7 wherein said pocket workpiece includes a flap which covers the open upper edge of the pocket.

9. A method for constructing garments to reduce premature wear around pockets, each pocket having an open upper edge, an upper corner at each end of the upper edge, and a peripheral edge defining the shape of the pocket and sewn to a garment substrate, the method comprising the steps of:

cutting a pocket workpiece to include a top edge including a first end and a second end, a peripheral workpiece edge beginning at a first point and ending at a second point, said peripheral workpiece edge defining the shape of a pocket, a first miter connecting said first end and said first point, a second miter connecting said second end and said second point;

folding said top edge of said pocket workpiece twice to encase said top edge to form an upper pocket edge, a first upper corner, and a second upper corner whereby said first and second upper corner do not extend substantially below an axis connecting said first point and said second point;

folding said peripheral workpiece edge once to form a peripheral pocket edge extending substantially from said first upper corner to said second upper corner, a first flap at said first upper corner and a second flap at said second upper corner, said first and second flaps extending above said upper pocket edge;

folding said first and second flaps down behind and beneath said upper pocket edge;

attaching said first and second flaps and said top edge to form a finished pocket upper edge;

positioning said pocket workpiece on the garment substrate; and, stitching said pocket workpiece to the garment substrate along a peripheral stitching line.

10. The method of claim 9 wherein said peripheral stitching line is substantially parallel to and spaced a sufficient distance from the peripheral pocket edge so that the peripheral edge will remain substantially flexible after sewing.

11. The method of claim 10 wherein said peripheral stitching line is located about 3/16 inch from said peripheral edge of the pocket.

12. The method of claim 9 additionally including the step of adding a reinforcing bar tack adjacent to each upper corner, said reinforcing bar tack having a stitch density sufficiently low so that each stitch in said bar tack creates a distinct stitch hole which does not coincide with any other stitch hole made by any other stitch in said bar tack.

13. The method of claim 12 wherein said reinforcing bar tack has a stitch density of not more than about 52 stitches per inch.

14. The method of claim 12 wherein said bar tack is located between a center of said pocket and said peripheral stitching line.

15. The method of claim 9 wherein the pocket is free from stitches that cross from the pocket to the garment substrate over the peripheral edge.

16. The method of claim 15 wherein said pocket includes a flap covering said open upper edge of said pocket.

17. The method of claim 9 wherein the garment being constructed is a pair of trousers, the pockets being attached are rear pockets.

18. A garment constructed to avoid premature wear around pockets, said garment comprising:

a garment substrate;

a pocket stitched to said garment substrate, said pocket having an open upper edge, a first upper corner on one end of said upper edge, a second upper corner on an opposite end of said upper edge, and a peripheral pocket edge which defines the shape of the pocket, said pocket formed from a pocket workpiece having a top raw edge including a first end and a second end, a peripheral workpiece raw edge beginning at a first point and ending at a second point, said first and second points spaced away from said top edge, a first miter connecting said first end and said first point, a second miter connecting said second end and said second point, the open edge of the pocket formed by folding said top raw edge twice along a first folding axis and a second folding axis, said first folding axis located between said top raw edge and an axis extending from said first point to said second point, and said second folding axis located between said first folding axis and said axis extending from said first point to said second point, to encase said top raw edge, the peripheral pocket edge formed by folding the peripheral workpiece raw edge once to form a peripheral pocket edge extending substantially from said first upper corner to said second upper comer, also forming a first flap extending above said open edge of the pocket at a first end and a second flap extending above said open edge of the pocket at a second end;

the first upper comer formed by folding said first flap down behind and beneath said open upper edge;

the second tipper comer formed by folding said second flap down behind and beneath said open upper edge;

said first upper corner and said second upper corner being located at or above an axis passing between said first point and said second point;

said pocket stitched to said garment substrate along a peripheral stitching line spaced from said peripheral pocket edge a sufficient distance so that said peripheral edge will remain substantially flexib!e after it is sewn to the garment substrate.

19. The garment of claim 18 wherein said peripheral stitching line is substantially parallel to said peripheral edge of said pocket and spaced about 3/16 inch from said peripheral edge of said pocket.

20. The garment of claim 18 additionally including a first bar tack for reinforcing said first upper corner and a second bar tack for reinforcing said second upper corner, said first and second bar tacks located between said peripheral stitching line and a center of said pocket.

21. The garment of claim 20 wherein each said reinforcing bar tack has a stitch density sufficiently low so that each stitch in said bar tack creates a distinct stitch hole which does not coincide with any other stitch hole made by any other stitch in said bar tack.

22. The garment of claim 21 wherein said stitch density does not exceed 52 stitches per inch.

23. A method for constructing garments to reduce premature wear of garment substrate fabric around pockets, each pocket having an open upper edge, an upper comer at each end of the upper edge, and a peripheral edge defining the shape of the pocket and sewn to a garment substrate, the method comprising the steps of:

cutting and folding a pocket workpiece for attachment to the garment substrate to form the upper edge, upper corners, and peripheral edge, whereby a substantial portion of an upper comer is formed from not more than six plies of fabric;

stitching the pocket workpiece to the garment substrate along a peripheral stitching line;

adding a reinforcing bar tack to each upper corner, said reinforcing bar tack having a stitch density sufficiently low so that each stitch in said bar tack creates a distinct stitch hole which does not coincide with any other stitch hole made by any other stitch in said bar tack.

* * * * *

UNITED STATES PATENT AND TRADEMARK OFFICE

CERTIFICATE OF CORRECTION

PATENT NO. : 6,138,595

DATED : October 31, 2000

INVENTOR(S) : Croyle

It is certified that error appears in the above-identified patent and that said Letters Patent is hereby corrected as shown below:

Col. 1, line 48: "cannot" should be --can--

Col. 3, line 44, "outside surface 56" should be --outside surface 58--.

Col. 3, line 32, "and" should be --are--

Col. 5, line 66, "exzymes" should be --enzymes--.

Claim 1, line 25: "tipper" should be --upper--.

Claim 1, line 27: "comer" should be --corner--.

Claim 4, line 2: "rein forcing" should be --reinforcing--

Claim 18, line 32: "comer" should be --corner--

Claim 18, line 34: "tipper comer" should be--upper corner--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*